United States Patent [19]

Bosshart et al.

[11] Patent Number: 4,562,655

[45] Date of Patent: Jan. 7, 1986

[54] HIGH MOMENTUM HEATING SYSTEM FOR AN IRONER

[75] Inventors: John Bosshart, Coral Springs; William W. Allen, Plantation; C. Robert Safarik, Tampa, all of Fla.

[73] Assignee: Jensen Corporation, Ft. Lauderdale, Fla.

[21] Appl. No.: 737,796

[22] Filed: May 28, 1985

[51] Int. Cl.[4] ..... D06F 65/02; D06F 67/02

[52] U.S. Cl. ..... 38/52; 38/56; 34/124; 432/60; 432/222; 100/93 RP; 100/157; 374/153; 236/1 R

[58] Field of Search ..... 100/93 RP, 157, 63; 38/52, 56; 34/124, 119, 48; 432/60, 222, 228; 374/153, 154; 236/1 R

[56] References Cited

U.S. PATENT DOCUMENTS

| | | | |
|---|---|---|---|
| 1,107,737 | 8/1914 | Witham, Sr. et al. . | |
| 1,634,353 | 7/1927 | Frantz | 432/60 X |
| 1,819,534 | 8/1931 | Akerlow | 432/60 |
| 2,362,947 | 12/1942 | Sullivan | 38/49 |
| 2,817,908 | 12/1957 | Hornbostel | 34/119 X |
| 3,156,454 | 11/1964 | Flynn | 432/222 |
| 3,220,340 | 11/1965 | Frykhult | 100/157 X |
| 3,452,967 | 7/1969 | Durand | 34/119 X |
| 3,690,626 | 9/1972 | Vernazza | 432/222 X |
| 3,739,397 | 3/1973 | Rose | 38/52 |
| 4,244,349 | 1/1981 | Velie et al. | 432/222 X |
| 4,321,828 | 3/1982 | Grimes et al. | 374/153 X |
| 4,385,455 | 5/1983 | Withers, Jr. et al. | 34/124 X |

*Primary Examiner*—Werner H. Schroeder
*Assistant Examiner*—Andrew M. Falik
*Attorney, Agent, or Firm*—Oltman and Flynn

[57] ABSTRACT

A gas heated direct fired center tube revolving ironer for use in an automated fabric ironing environment features improved roller surface temperature distribution control. An adjustable hot air recirculation system with a venturi throat, a high momentum gas burner, an improved temperature control system and an exhaust blower cooperate to provide an even temperature along the ironing surface. Multiple high and low temperature controls provide backup and ensure accuracy and safety. The gas fuel consumption is minimized thereby reducing operating costs.

12 Claims, 7 Drawing Figures

HIGH MOMENTUM HEATING SYSTEM FOR AN IRONER

BACKGROUND OF THE INVENTION

The present invention relates to an improved heating system for gas heated direct fired center tube revolving ironers. The primary purpose of the invention is to produce a smoothly ironed surface on the laundry work piece. The primary objects sought are to provide an evenly heated roller surface, maximum fuel efficiency and maximum operator safety.

The controlled and uniform heating of the surface of a rotating ironing cylinder has been an industrial control problem since the turn of the century. Many means have been used to provide an even roller surface temperature including steam applied directly into the cylinder, a gas flame inside the hollow cylinder and water jackets inside the cylinder. Many complicated and expensive devices have been used.

The use of a gas flame heating the air in a tube mounted in the center of the roller has proven to be the simplest and most economical approach. Super heated air at high velocity moves down the tube propelled by a gas burner mounted at one end of the roller. This air retains most of the heat imparted by the gas flame causing the entire tube to glow red. The air is then forced back down the cylinder along the inside roller surface exchanging its heat with the ironing surface. The air then exits out the same end of the roller as the burner.

The problems with this simple design include the danger of trapped gas in the roller exploding, inaccurate temperature control of the heating surface by mere modulation of the gas flame for varying loads and inefficient use of the gas with the resultant high cost.

PRIOR ART

U.S. Pat. No. 1,107,737 (1914) to Witham and Roesch discloses a temperature control device for calender rollers which is primarily used in continuous paper production. Two rollers are heated by steam injection inside. A temperature sensor in the first roller regulates steam to a second roller which maintains a constant temperature for the variable flow of pulp.

U.S. Pat. No. 2,362,947 (1944) to Sullivan discloses a direct fired center tube revolving ironer and dryer. The means for uniformly heating a cylinder used as a roll ironer include a tube inside the roller which conveys hot gases down the center then back along the outside heating surface. A gas flame inside the tube supplies the heat, propelling hot air down the tube then around the tube and back down the inner surface of the roller before exiting. The tube is supported within the roller by a plurality of spaced arms so the tube rotates with the roller. The gas burner is mounted in the tube to provide a narrow flame. A second roller may be attached to share the exiting hot air. Temperature is controlled by modulating the gas flame.

U.S. Pat. No. 2,739,397 (1956) to Rose discloses a cloth treating calender. It is comprised of a two roller gas heated calender with an automatic pivotal lifting means to step over seams and also to continue to rotate when lifted and thus maintain a constant roller temperature.

SUMMARY OF THE INVENTION

The primary object of the present invention is to provide a practical means for maximizing the temperature control accuracy of a revolving cylinder ironer. The secondary object is to maximize operator safety. The third object is to lower operating costs by maximizing the heat utilization of the gas flame with an air feedback loop and blower. The means utilized include:

First, the mounting of a high velocity gas burner outside the roller projecting its flame down through the center tube.

Second, the use of a movable plate outside the roller to act as a temperature control means by restricting the exit of exhaust air which exhaust air is re-circulated back down the tube to exchange more of its heat back into the tube and roller before being discharged into the air. The use of recirculated hot air rather than cold air for flame dilution provides uniform temperature distribution, preserves the center tube integrity and increases fuel efficiency. The design of the ratio of the diameter of the center tube to the diameter of the cylinder, plus the degree of recirculated air flow, plus the degree of entrainment of the burner fuel in the recirculated air flow result in uniform temperature distribution along the cylinder length. The center tube contains a venturi where the flame enters which aids in recirculating the hot air.

Third, an exhaust air temperature sensing thermocouple is utilized. An ultraviolet sensing flame detector is utilized. This system provides backup safety shutoff controls for the gas burner.

Fourth, the exhaust gas temperature sensor is used to control the temperature of the roller. This method provides rapid control responses and reliability which cannot be obtained using roller temperature sensing means.

Fifth, the exhaust gas sensor also modulates a fully proportional gas burner temperature controller to maintain a constant ironing surface temperature.

Sixth, a four wheel roller surface thermocouple temperature sensor measures the roller surface temperature to provide an extra high level cut-off means in order to prevent damage to the cloth. An easily changeable wear surface gives the thermocouple a long life.

Seventh, the center tube is supported by flexible struts which take up differential expansion and provide further air turbulence for improved heat exchange with the roller.

Eighth, an inner lining of tapered or stepped width inside the roller at the end opposite the burner helps to maintain a constant temperature across the roller surface.

All of the above improvements are added to the basic design of the Direct Fired Revolving Ironer and Drier, U.S. Pat. No. 2,362,947 to Sullivan.

In the preferred embodiment the cylindrical roller is totally sealed and insulated at the end opposite the gas burner. The center tube is mounted within the cylinder leaving approximately six inches of clearance from the closed end of the roller. The tube is supported by "U" shaped brackets which withstand the dimensional changes caused by the heat. The end of the tube adjacent to the gas flame is closed to an inside diameter of approximately six inches to allow the flame to enter the tube. The tube is approximately flush with the end of the roller adjacent to the flame.

A movable round plate slightly larger than the diameter of the roller is mounted at the open end of the roller. The mounting means allow for the plate to be locked into various positions. The plate is insulated with fabricated fibre refractory block rated at 1600° F. The insulation covers the plate with enough clearance at the edges to fit snugly inside the roller when the plate is flush against the roller. The high velocity gas burner is mounted in the center of the plate allowing the flame to project down the center of the tube. Thermocouple sensors are mounted as noted above. During operation the plate is manually locked into the position which produces the optimum roller temperature distribution for the work load passing under the ironing surface.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Figure 1:
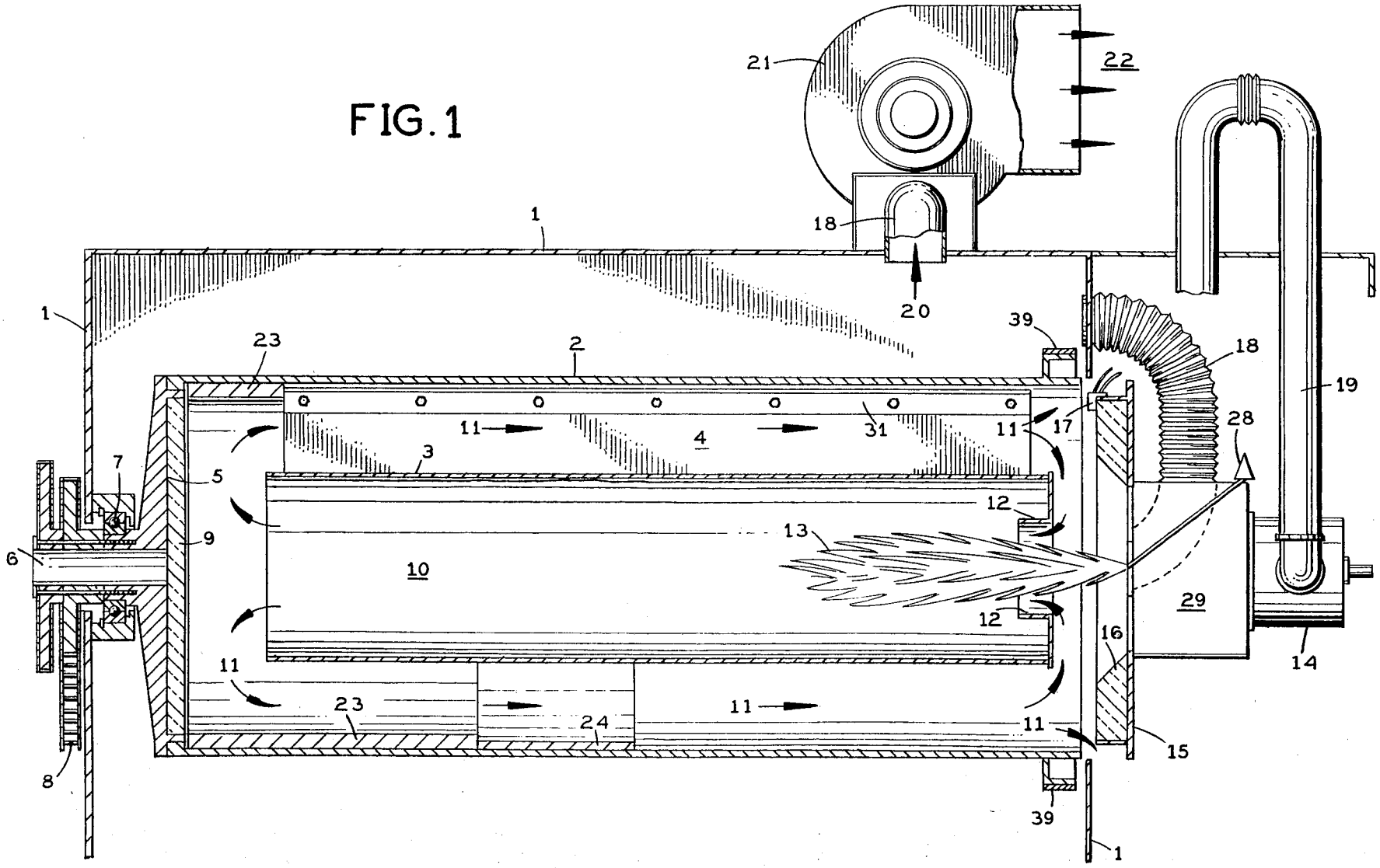
FIG. 1 is a vertical section of the revolving cylinder and center tube.

FIG. 1 shows the basic design of the present invention. A frame 1 houses a revolving ironing cylinder 2 which is mounted by means of an axle 6 and a bearing 7 supported by the frame 1. The revolving cylinder 2 is turned by means of a chain sprocket 8. Mounted within the cylinder 2 by brackets 4 is the center tube 3. The center tube 3 is open adjacent to the closed end 5 of the cylinder 2. The closed end 5 of the cylinder 2 is insulated 9 against the hot air 10 in the center tube 3. The insulation 9 minimizes heat loss and increases fuel efficiency. The center tube 3 is partially closed with a venturi throat 12 at the end adjacent to the open end of cylinder 2. The venturi throat 12 focuses the burner flame 13 down the center tube 3 and assists the recirculating of exhaust air 11.

A movable plate 15 is mounted adjacent to the open end of the revolving cylinder 2. This movable plate is insulated 16 such that plate 15 with insulation 16 could provide a tight fit enclosing the open end of cylinder 2. A high velocity gas burner 14 is mounted to the movable plate 15. The high velocity gas burner 14 is fed with low pressure air 19 to produce intense combustion and project hot gases at high velocity a substantial distance down the center tube 3.

A heat sensor 17 is mounted in the space between the plate 15 and the revolving cylinder 2. This heat sensor 17 measures the exhaust air 11 temperature. An ultraviolet flame detector 28 mounted on the high velocity gas burner 14 shuts down the burner in case of a flame out condition to prevent unlit gases from collecting in the cylinder 2.

Figure 4:
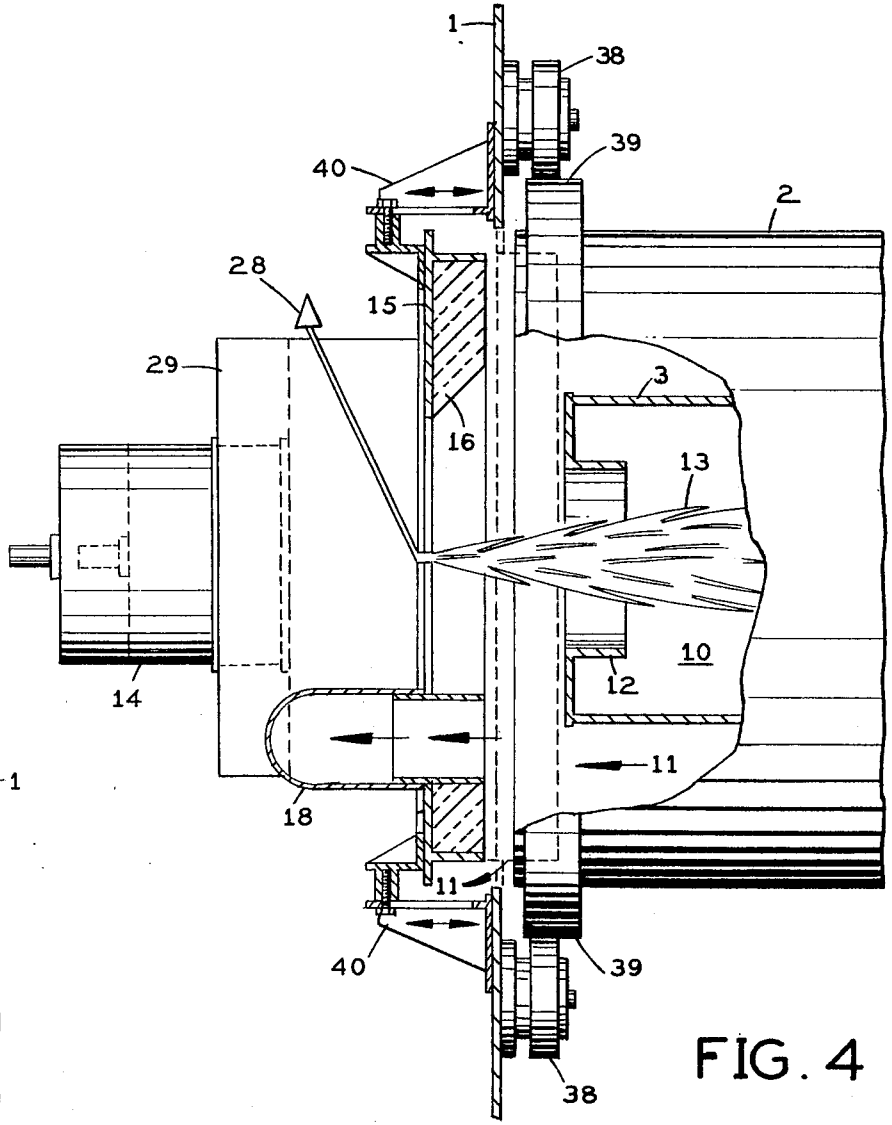
FIG. 4 is a vertical section of the burner, movable plate, revolving cylinder and center tube.

The movable plate 15 is supported in this embodiment by mounting brackets 40 (see FIG. 4).

Figure 2:
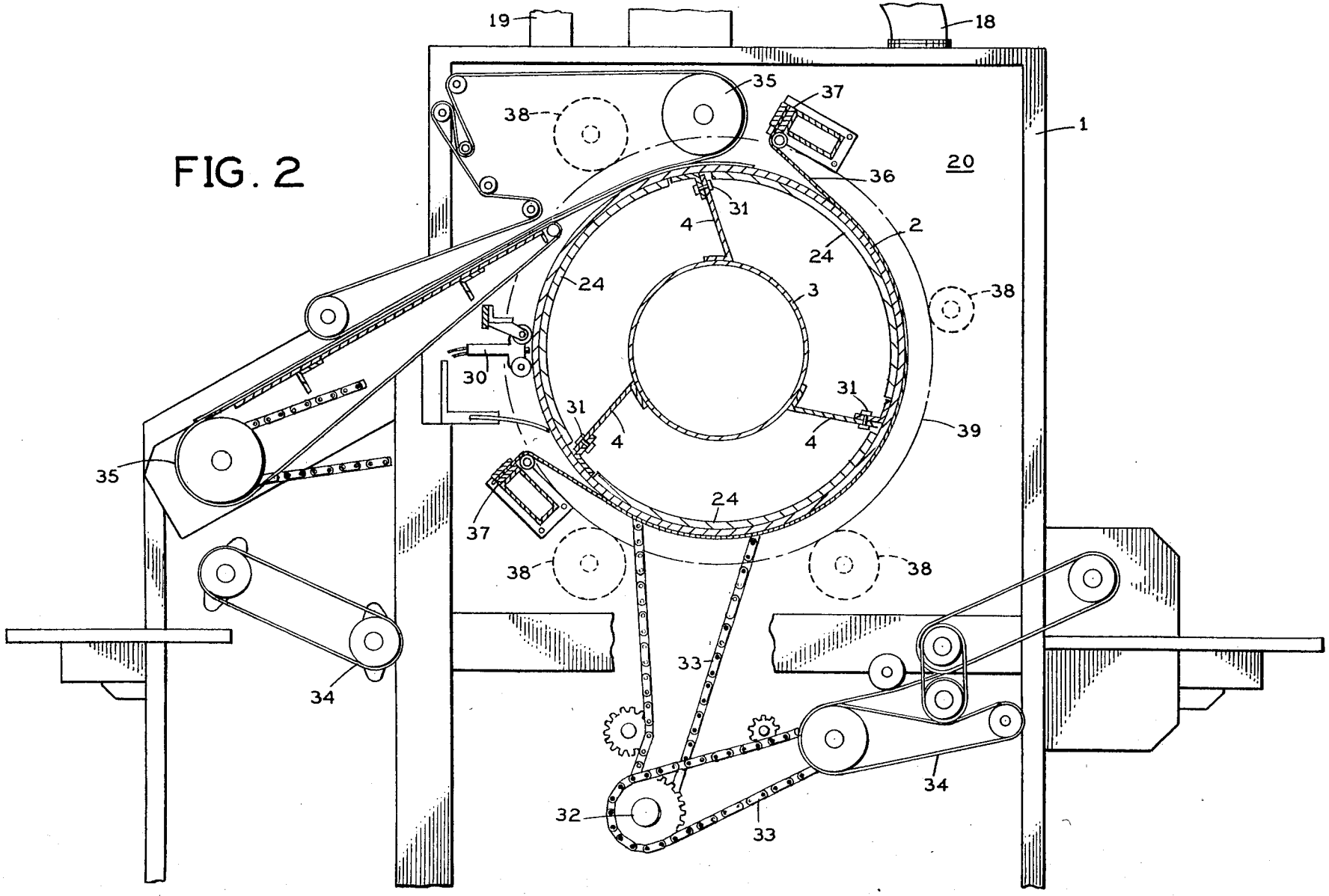
FIG. 2 is a vertical section of the end of the revolving cylinder.

Normal operating conditions provide for the cylinder 2 to rotate, thus ironing and drying laundry work pieces as they pass over its outer surface and against an ironing bed 6, FIG. 2. The position of the movable plate 15 is set to allow the proper hot exhaust air 11 to feed back into the center tube 3 via the end venturi throat 12 or to vent to atmosphere 22. Once the plate 15 position is set, the temperature controller 29 senses the exhaust air temperature 11 by means of heat sensor 17 and maintains a constant exhaust air 11 temperature. Exhaust duct 18 is mounted to the plate 15 adjacent to the high velocity gas heater 14 such as to conduct hot exhaust air 11 into the space 20 by means of an exhaust blower 21. The blower 21 then conducts the moisture collected in space 20 out to the atmosphere 22.

Turbulence of hot air 10 changing direction at the closed end of the cylinder 2 imparts more heat to the closed end of the cylinder than the open end adjacent to burner 14. Inside sleeves 23 and 24 serve to insulate the surface of cylinder 2 from the hot air 10. Sleeve 23 projects approximately two feet from the closed end 5 at a width of approximately one eighth inch. Sleeve 24 projects approximately an additional foot away from closed end 5 at a width of approximately one sixteenth inch.

FIG. 2 displays the position of the roller type surface temperature sensing thermocouple 30 on the revolving cylinder 2. This temperature sensor acts as a high limit protector to avoid damage to the laundry work pieces. The thermocouple 30 activates burner shutoff by means of controller 29 shown in FIG. 1.

The center tube 3 is mounted in the center of the revolving cylinder 2 by means of a series of 'U' shaped struts or brackets 4. These brackets 4 are adjustable by means of nut and bolt assembly 31. The unique shape of brackets 4 allows for expansion and contraction of the cylinder 2 and center tube 3 in the intense heat generated by the high velocity gas burner 14 shown in FIG. 1.

The revolving cylinder 2 is provided with a weight bearing ring 39. Heavy duty bearings 38 mounted to frame 1 keep the cylinder 2 in position. Ironing bed 36 is affixed against the cylinder surface by anchoring means 37. Conveyor system 35 feeds the laundry work pieces between the cylinder 2 and the ironing bed 36. Ironing and drying takes place in space 20. Conveyor system 34 moves the ironed laundry work pieces away from the ironer. Motor armature 32 powers both the conveyor systems 34 and 35 and the cylinder by chain means 33.

Figure 3:
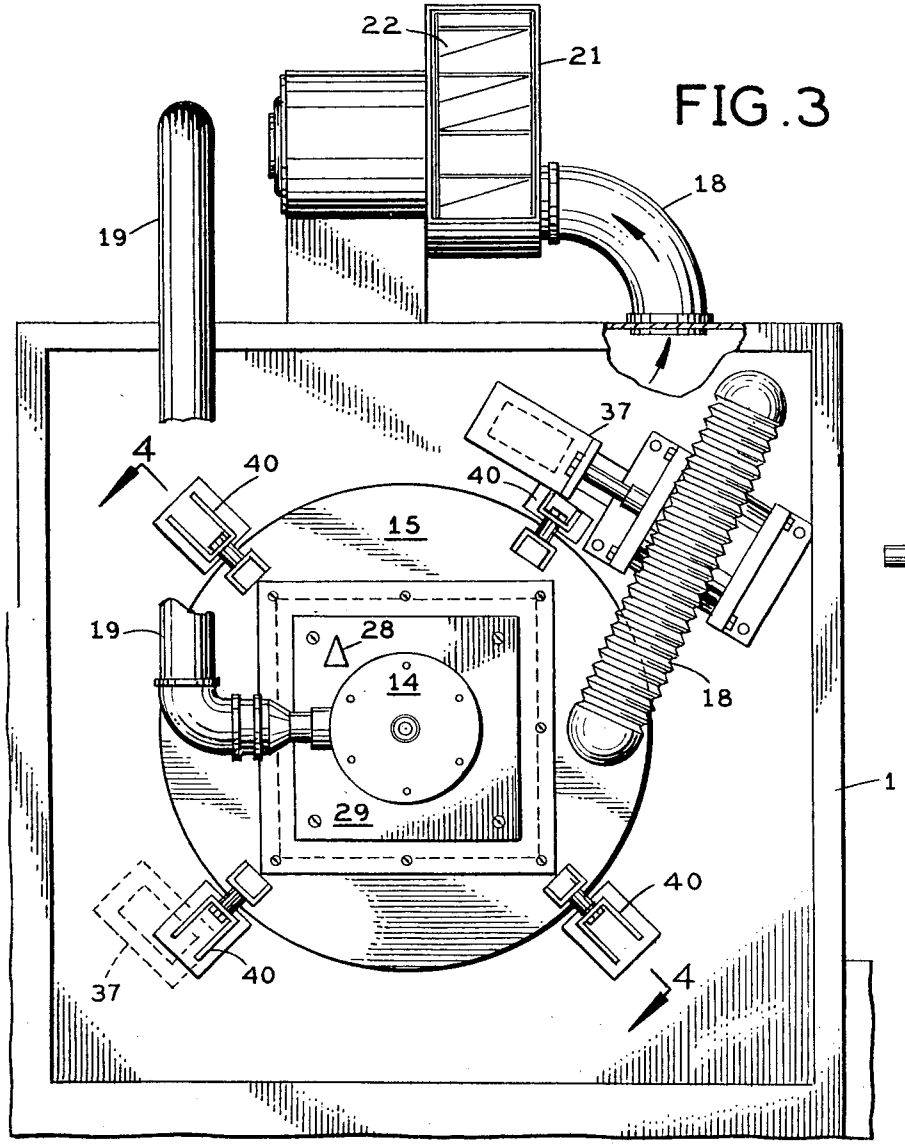
FIG. 3 is a vertical section of the burner end of the revolving cylinder showing the movable plate and mounting guides.

FIG. 3 shows the high velocity burner 14 and controller 29 mounted to the movable plate 15. A full view of the hot air exhaust duct 18 is depicted conducting exhaust air from inside the cylinder (not shown) to the atmosphere 22 by means of a blower 21. Adjustable locking mounting bracket guides 40 help support the weight of plate 15 and lock it in a fixed position during operation.

FIG. 4 is a cross section along lines 4 of FIG. 3. A close up is provided of the movable plate 15 in various positions relative to cylinder 2. Mounting brackets 40 allow the plate 15 with all its fixtures including the burner 14, insulation 16, controller 29 and flame detector 28 to be moved and locked at varying distances from the cylinder 2 thus allowing adjustment of the recirculation of the hot exhaust air 11 as well as its venting to atmosphere.

Figure 5:
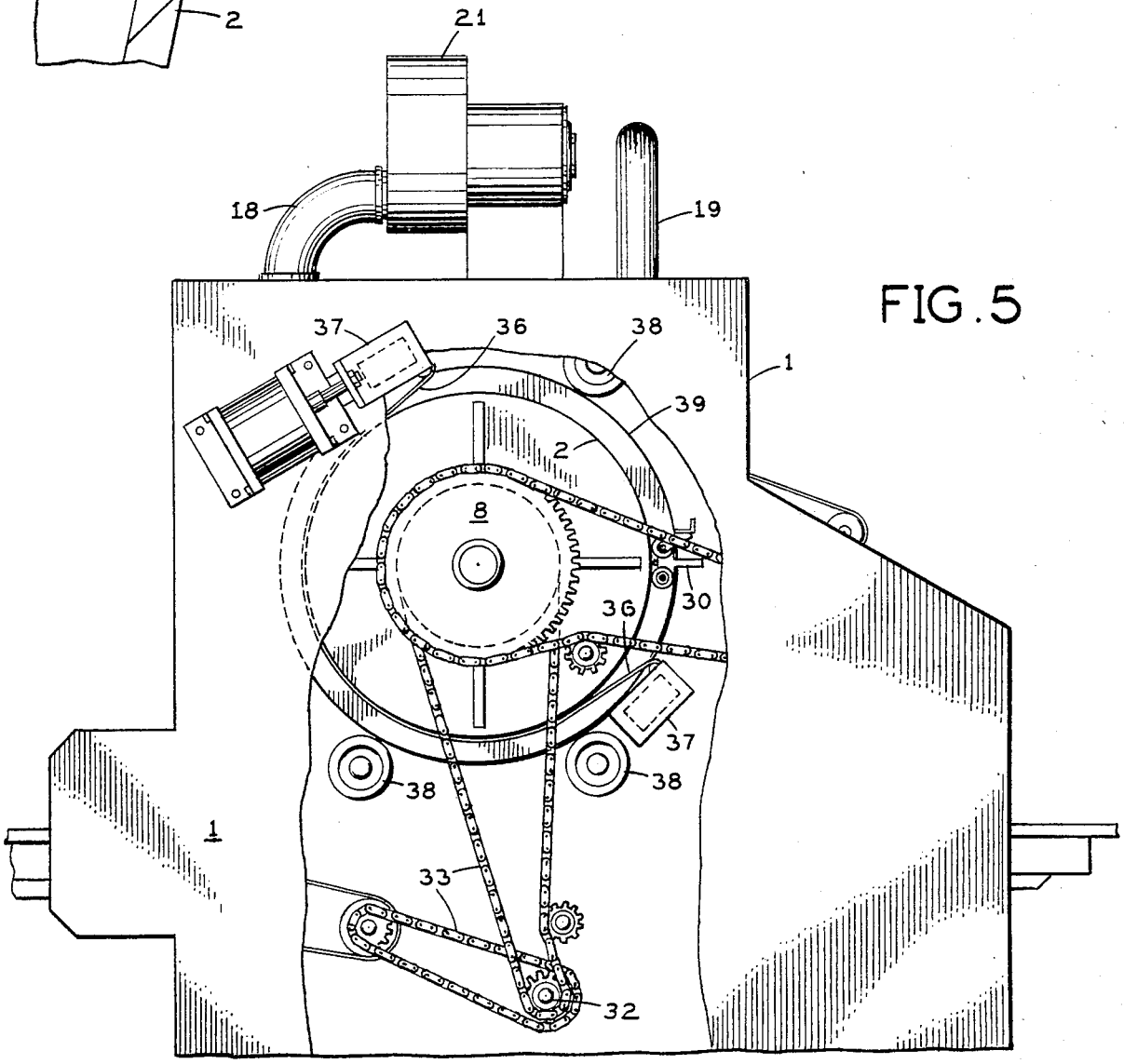
FIG. 5 is a vertical section of the end of the revolving cylinder showing the position of the drive chain.

FIG. 5 provides the viewer with a more complete description of the machinery driving the rotating cylinder 2 at the end opposite the burner (not shown). A motor armature 32 powers the chain means 33 to rotate the cylinder 2 via its sprocket 8. The cylinder 2 is mounted by its weight bearing ring 39 which is supported by heavy duty bearings 38. Anchor means 37 hold the ironing bed 36 taught against the cylinder during operation. The cylinder 2 surface sensing thermocouple 30 rolls on the cylinder while affixed to the frame 1.

Figure 6:
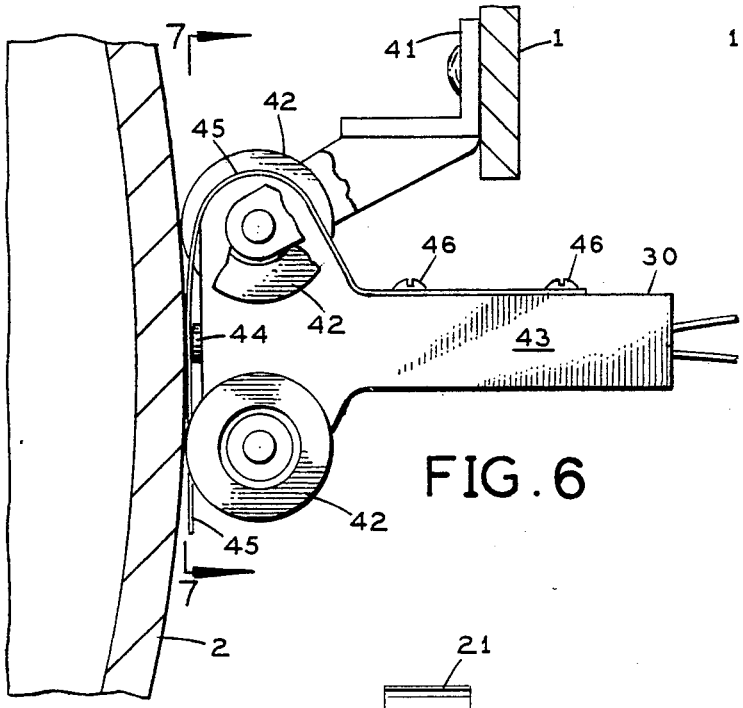
FIG. 6 is a close up of the roller type surface measuring thermocouple assembly.

FIG. 6 is a close up of the cylinder 2 roller type surface temperature sensor 30. Mounting means 41 affix the sensor 30 to the frame 1. Roller wheels 42 are mounted on rod 43 and roll on the cylinder surface 2. The thermocouple 44 protrudes from the rod 43 usually touching cylinder 2. The unique wear surface 45 slips between the cylinder 2 and the thermocouple 44 thus reducing thermocouple wear. The wear surface strip 45 is affixed to the rod 43 by anchor means 46. Ease of maintenance is featured here as the wear surface strip 45 can be quickly replaced by mounting means 46.

Figure 7:
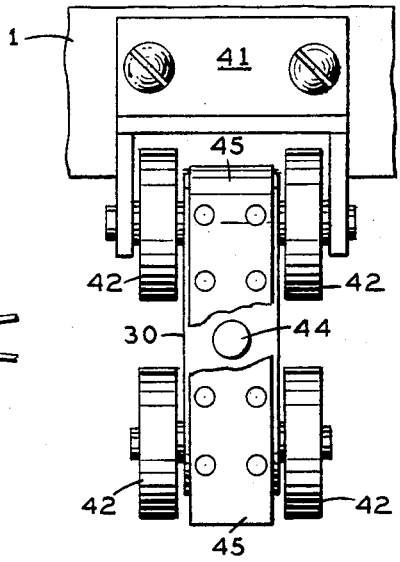
FIG. 7 is a similar close up of the bottom of the roller type surface measuring thermocouple.

FIG. 7 is the bottom view of roller temperature sensor 30. Wear surface strip 45 protects the thermocouple 44 from wearing against the cylinder (not shown).

We claim:

1. A gas heated direct fired center tube revolving ironer and dryer comprising:

a rectangular frame enclosing a revolving cylinder the outer surface of which provides an ironing surface;

a tube concentrically supported within the cylinder by a plurality of spaced struts rigidly attached to the tube and cylinder whereby the tube and cylinder revolve together;

said cylinder being closed at one end and open at the other;

said tube being open at both ends and terminating short of said closed end of the cylinder to provide a chamber through which said tube communicates with the space between the tube and the cylinder;

a movable plate mounted by means such that it can be positioned adjacent to the open end of the cylinder; and said movable plate having a means to be locked into a selected position;

said plate having a high velocity gas burner mounted in the center thereof allowing the flame to be projected down the center of said tube, and said burner having a full proportional flame temperature controller and a high temperature cut-off for said controller.

2. The ironer of claim 1 wherein said plate is insulated on the cylinder side to withstand high temperatures with the insulating material in a circular shape slightly smaller in diameter than the inside of the roller.

3. The ironer of claim 1 further comprising an electric air blower and ductwork connected to the plate adjacent to the burner functioning to draw exhaust air from the space between said tube and cylinder and project it into the space between the cylinder and the rectangular frame and further ducted to project the air from the space between the frame and the cylinder to the atmosphere.

4. The ironer of claim 1 further comprising a thermocouple temperature sensing device measuring the exhaust air temperature in the space between the cylinder and the movable plate, said thermocouple activating both said high and low temperature cut-off controller on the burner.

5. The ironer of claim 4 wherein the exhaust air thermocouple activates a temperature indicator.

6. The ironer of claim 4 wherein the exhaust air thermocouple activates a full proportioning temperature controller on the burner.

7. The ironer of claim 1 wherein said high velocity gas burner is further comprised of an ultraviolet flame eye detector and shutoff controller whereby said flame eye detector immediately activates the gas burner shutoff controller upon sensing a no flame condition during operation.

8. The ironer of claim 1 wherein said cylinder further comprises a variable thickness temperature insulating sleeve inside at the closed end.

9. A gas heated direct fired center tube revolving ironer and dryer comprising:

a rectangular frame enclosing a revolving cylinder the outer surface of which provides an ironing surface;

a tube concentrically supported within the cylinder by a plurality of spaced struts rigidly attached to the tube and cylinder whereby the tube and cylinder revolve together;

said cylinder being closed at one end and open at the other;

said tube being open at both ends and terminating short of said closed end of the cylinder to provide a chamber through which said tube communicates with the space between the tube and the cylinder;

a movable plate mounted by means such that it can be positioned adjacent to the open end of the cylinder; and said movable plate having a means to be locked into a selected position;

an ironing surface temperature sensor comprising a thermocouple mounted between rollers which roll on the ironing surface, said thermocouple being mounted in direct contact with a wear surface strip of heat resistant and conductive material which intercedes between the ironing surface and the thermocouple element; said plate having a high velocity gas burner mounted in the center thereof allowing the flame to be projected down the center of said tube.

10. The ironer of claim 9 with said thermocouple activating a high limit temperature controller cut-off on the burner.

11. A gas heated direct fired center tube revolving ironer and dryer comprising:

a rectangular frame enclosing a revolving cylinder the outer surface of which provides an ironing surface;

a tube concentrically supported within the cylinder by a plurality of spaced struts rigidly attached to the tube and cylinder whereby the tube and cylinder revolve together;

said cylinder being closed at one end and open at the other;

said tube being open at both ends and terminating short of said closed end of the cylinder to provide a chamber through which said tube communicates with the space between the tube and the cylinder;

a movable plate mounted by means such that it can be positioned adjacent to the open end of the cylinder; and said movable plate having a means to be locked into a selected position;

said struts being capable of withstanding dimensional changes of the cylinder and center tube cause by heat; said plate having a high velocity gas burner mounted in the center thereof allowing the flame to be projected down the center of said tube.

12. The ironer of claim 4 wherein the tube is further comprised of a venturi throat opening at the burner end.

* * * * *